US005761939A

United States Patent [19]

Spencer et al.

[11] Patent Number: 5,761,939

[45] Date of Patent: Jun. 9, 1998

[54] AUTOMATIC INDEXER FOR A SHEET BENDING BRAKE

[75] Inventors: Daniel J. Spencer, Belleville; Arthur B. Chubb, Romulus; Matthew S. Damron, Dearborn Heights; James E. Suyak, Lincoln Park, all of Mich.

[73] Assignee: Tapco International Corp., Plymouth, Mich.

[21] Appl. No.: 791,192

[22] Filed: Jan. 31, 1997

[51] Int. Cl.[6] ..... B21C 51/00; B21D 5/04

[52] U.S. Cl. ..... 72/31.1; 72/307; 72/319; 72/420

[58] Field of Search ..... 72/307, 319, 320, 72/322, 31.1, 420

[56] References Cited

U.S. PATENT DOCUMENTS

| | | | |
|---|---|---|---|
| 366,486 | 7/1887 | Kimmel | 72/319 |
| 404,164 | 5/1889 | Buckman | 72/319 |
| 1,872,670 | 8/1932 | Burns | 72/320 |
| 3,729,969 | 5/1973 | Gibson | 72/307 |
| 3,815,393 | 6/1974 | Daniels | 72/320 |
| 4,489,583 | 12/1984 | Rhoades | 72/319 |

FOREIGN PATENT DOCUMENTS

| | | | |
|---|---|---|---|
| 46785 | 12/1978 | Japan | 72/319 |

*Primary Examiner*—Daniel C. Crane
*Attorney, Agent, or Firm*—Barnes, Kisselle, Raisch, Choate, Whittemore & Hulbert

[57] ABSTRACT

An automatic indexer a portable sheet bending brake having a first longitudinally extending member forming a clamp surface, a second longitudinally extending member movable with respect to the first member for clamping sheet material against the clamp surface, and a third member pivotally coupled to the second member for bending sheet material clamped between the first and second members over a bending anvil on the forward edge of the second member. The indexer includes a pair of slides having means for mounting the slides parallel to each other and spaced from each other lengthwise of the clamp surface on the bending brake. A pair of carriages are each slidably disposed on one of the slides, and a bar extends longitudinally between the carriages for engagement with an edge of sheet material inserted between the first and second members of the sheet bending brake. The carriages are resiliently biased toward the clamp surface of the sheet bending brake, and means are coupled to the carriages for relating distance between the anvil to the edge of sheet material in engagement with the bar. This distance is either a direct measure to the edge of the anvil for forming indexed bends, or an offset distance with respect to the anvil for indexing the sheet material for a cut employing a manual slitter that cuts the material at a predetermined offset distance from the anvil edge. Thus, the indexer automatically squares the cut or bend to the edge in engagement with the indexer, and automatically positions the bend or cut with respect to the anvil edge as controlled by the indexer.

24 Claims, 11 Drawing Sheets

AUTOMATIC INDEXER FOR A SHEET BENDING BRAKE

The present invention is directed to sheet bending brakes, and more particularly to an indexer for automatically indexing and squaring sheet material to be bent or cut in a sheet bending brake.

BACKGROUND AND OBJECTS OF THE INVENTION

Sheet bending brakes heretofore proposed generally comprise an elongated first member carried in fixed position on a frame and having an upper clamp surface, an elongated second member movable on the frame toward and away from the first member for clamping sheet material against the clamp surface, and a third member mounted beneath the first member and pivotal upwardly to bend sheet material so clamped over a bending anvil on the forward edge of the second member. Portable sheet bending brakes of this character are disclosed, for example, in U.S. Pat. Nos. 5,353,620 and 5,505,069 assigned to the assignee hereof, and in the several earlier patents referenced therein.

A problem associated with conventional sheet bending brakes lies in squaring sheet material with respect to the bending anvil as the sheet material is inserted into the brake. That is, it is generally desired that bends or cuts in the sheet material made with the assistance of the sheet bending brake be square and parallel to the edge of the sheet material and to each other. Making the cuts or bends square to the material edge can be a time-consuming operation, resulting in undesirable expense and scrap.

Another problem with conventional sheet bending brakes is the labor and expense associated with formation of compound bends (including hems) in the sheet material when forming building trim elements and the like. For example, it is conventional practice to employ a ruler or scale to make marks a long the ends of a length of sheet material, and to use these opposed marks in an effort not only to square the sheet material in the bending brake but also to locate the positions of the desired bends or cuts. For compound bends, marks must be made on both sides of the sheet. Another conventional technique is to employ a small strip of material, such as scrap material, to form the desired contour or profile of the trim element, including multiple bends and hems as desired. When the strip has been bent to satisfactory contour, it is then again flattened in such a way that the stresses imparted to the strip material at each bend are plainly visible on the flattened strip. The strip is then placed in turn along each end of the sheet of material to be contoured, and manual cutters or snips are used to mark the longitudinally spaced material ends at lateral positions at which the material sheet is to be bent or cut. After the sheet is bent and cut, the ends having the slits usually must be severed. It is self evident that this is a time-consuming and expensive operation that undesirably increases the costs of building construction.

It is therefore a general object of the present invention to provide an indexer for a sheet bending brake that automatically squares and positions the sheet material blanks for bending or cutting without slitting or otherwise marking the blanks. Another and more specific object of the present invention is to provide an automatic indexer for a sheet bending brake of the described character that has a scale for identifying bend and/or cut positions on a sheet material blank as the blank is inserted into the brake. A further object of the present invention is to provide an indexer of the described character that is adapted to receive and use a template strip having bend stress marks for indexing the sheet material for complex or compound bends and cuts as the material blank is inserted into the brake. Another object of the present invention is to provide an indexer of the described character that may be marketed as either original equipment on or retrofit onto otherwise conventional portable sheeting bending brakes.

SUMMARY OF THE INVENTION

An automatic indexer is provided in accordance with the present invention for use in conjunction with a sheet bending brake having a first longitudinally extending member forming a clamp surface, a second longitudinally extending member movable with respect to the first member for clamping sheet material against the clamp surface, and a third member pivotally coupled to the first member for bending sheet material clamped between the first and second members over a bending anvil on the forward edge of the second member. The indexer includes a pair of slide elements parallel to each other and spaced from each other lengthwise of the clamp surface on the bending brake. A pair of carriage elements are each slidably disposed on one of the slide elements, and a bar extends longitudinally between the carriage elements for engagement with an edge of sheet material as it is inserted between the first and second members of the sheet bending brake. The carriage elements are resiliently biased toward the clamp surface of the sheet bending brake, and means are coupled to the carriages for relating distance between the bending anvil to the edge of a sheet material blank in engagement with the bar. This distance is either a direct measure to the bending edge of the anvil for forming indexed bends, or an offset distance with respect to the anvil for indexing the sheet material blank for a cut employing a manual slitter that cuts the material at a predetermined offset distance from the anvil edge. Thus, the indexer automatically squares the cut or bend to the blank edge in engagement with the indexer, and automatically positions the bend or cut with respect to the anvil edge as controlled by the indexer.

Distance between the bending anvil and the sheet material edge (either direct measure or offset as described above) is determined by indexing means in either fixed or variable position with respect to the indexer slides. In presently preferred embodiments, an elongated slot is provided adjacent and parallel to one or both of the slides to receive a template strip having longitudinally spaced bend indicia positioned thereon. In an alternative embodiment, the template strip has apertures that are received over retaining pins on one or both slides. This bend indicia on the template strip may comprise either a scale printed on the template strip or bend stresses in the template strip. A pointer or other alignment device carried by one or both of the carriages moves longitudinally of the template as the sheet material is inserted into the bending brake so that an operator can observe when the sheet material has been inserted to an index position for a bend or cut. As an alternative or addition to the removable template strip, the indexing means may comprise one or more scales disposed in fixed position relative to the slides and operable with the pointer(s) or other alignment device(s) affixed to the carriages for displaying to an operator indexed position of the sheet material with respect to the bending anvil. As noted above, this scale may provide either a direct measure to the bending edge of the anvil, or an offset measure for use in conjunction with a manual sheet metal cutter.

The indexer in accordance with the various embodiments of the invention may be either fixedly mounted on the sheet bending brake at the time of manufacture, or removably mounted on the sheet bending brake for aftermarket retrofit. The slides in the preferred embodiment of the invention comprise spaced rods encircled by coil springs for resiliently biasing the carriages and the material-engagement bar toward the bending anvil. The slides in alternative embodiments of the invention comprise spaced parallel tube sections having elongated carriages slidable therein and coil springs biasing the carriages toward the bending anvil. Fingers are pivotally mounted to the bar in the various preferred embodiments of the invention for pivoting out of material-engagement position when sheet material is moved between the bending brake members as from a coil stand disposed at one end of the sheet bending brake, and for automatically pivoting back into material-engagement position by force of gravity.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
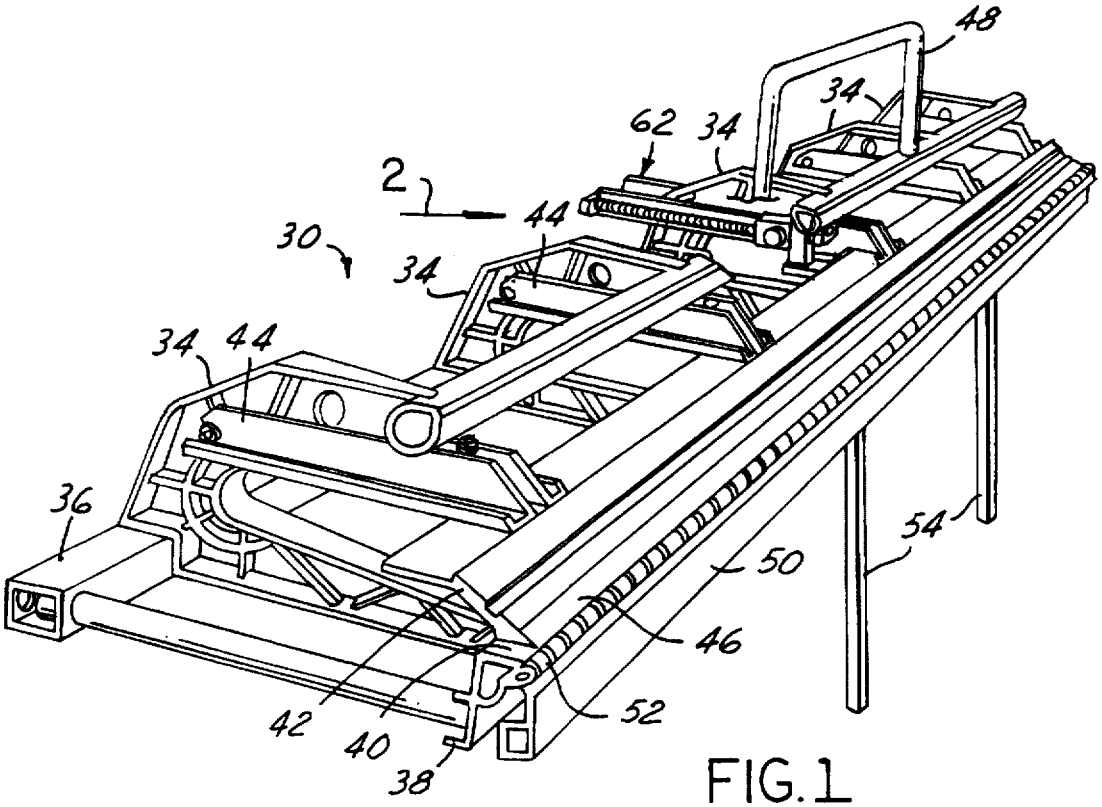
FIG. 1 is a front perspective view of a sheet bending brake equipped with an automatic indexer in accordance with one presently preferred embodiment of the invention.
Figure 2:
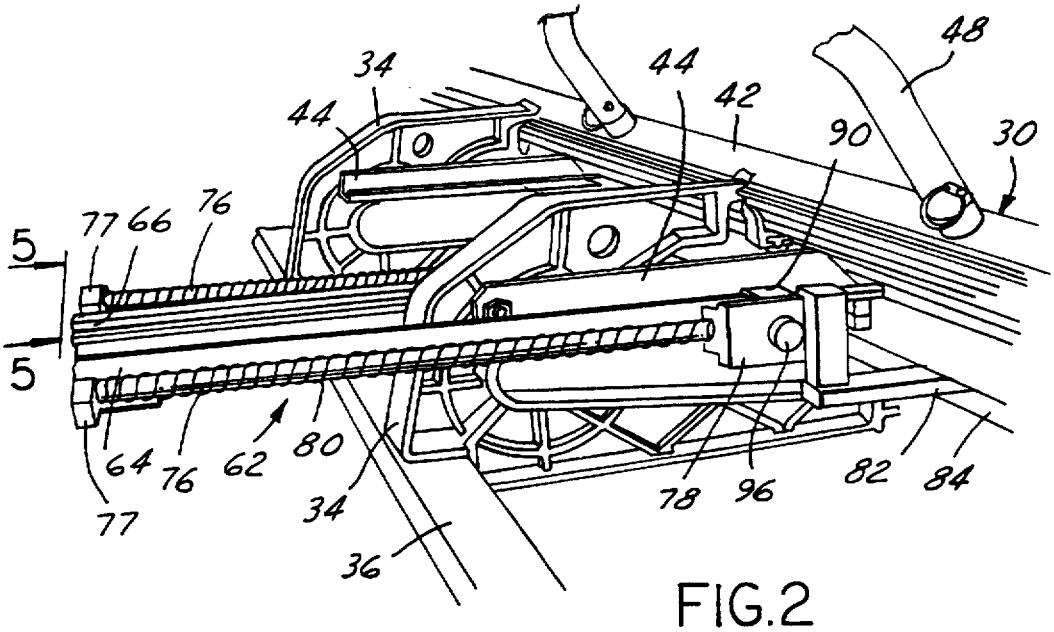
FIG. 2 is a fragmentary rear perspective view of the brake and indexer illustrated in FIG. 1, being taken substantially from the direction 2 in FIG. 1.
Figure 3:
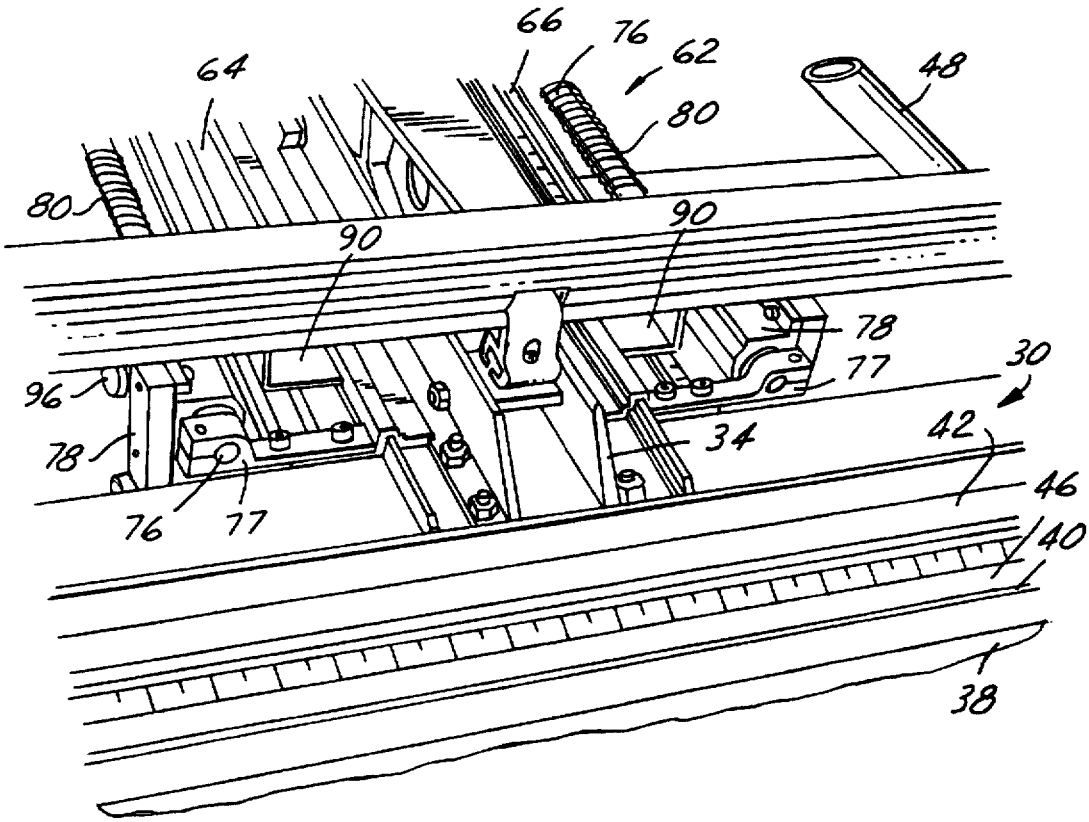
FIG. 3 is a fragmentary front perspective view of the indexer and brake in FIGS. 1–2.
Figure 5:
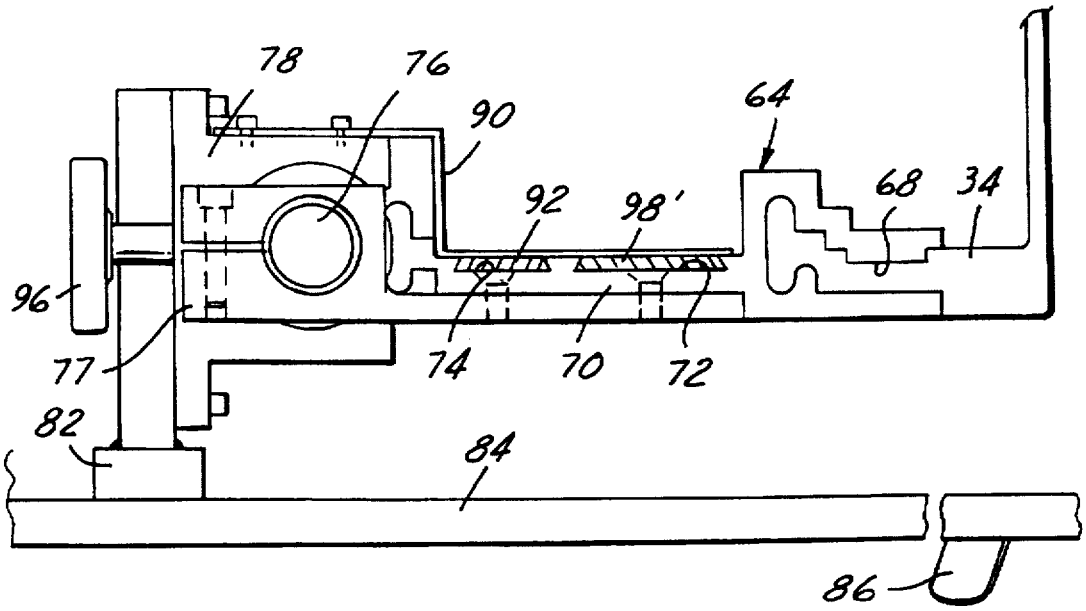
FIG. 5 is a fragmentary elevational view of a portion of the indexer illustrated in FIG. 4.
Figure 4:
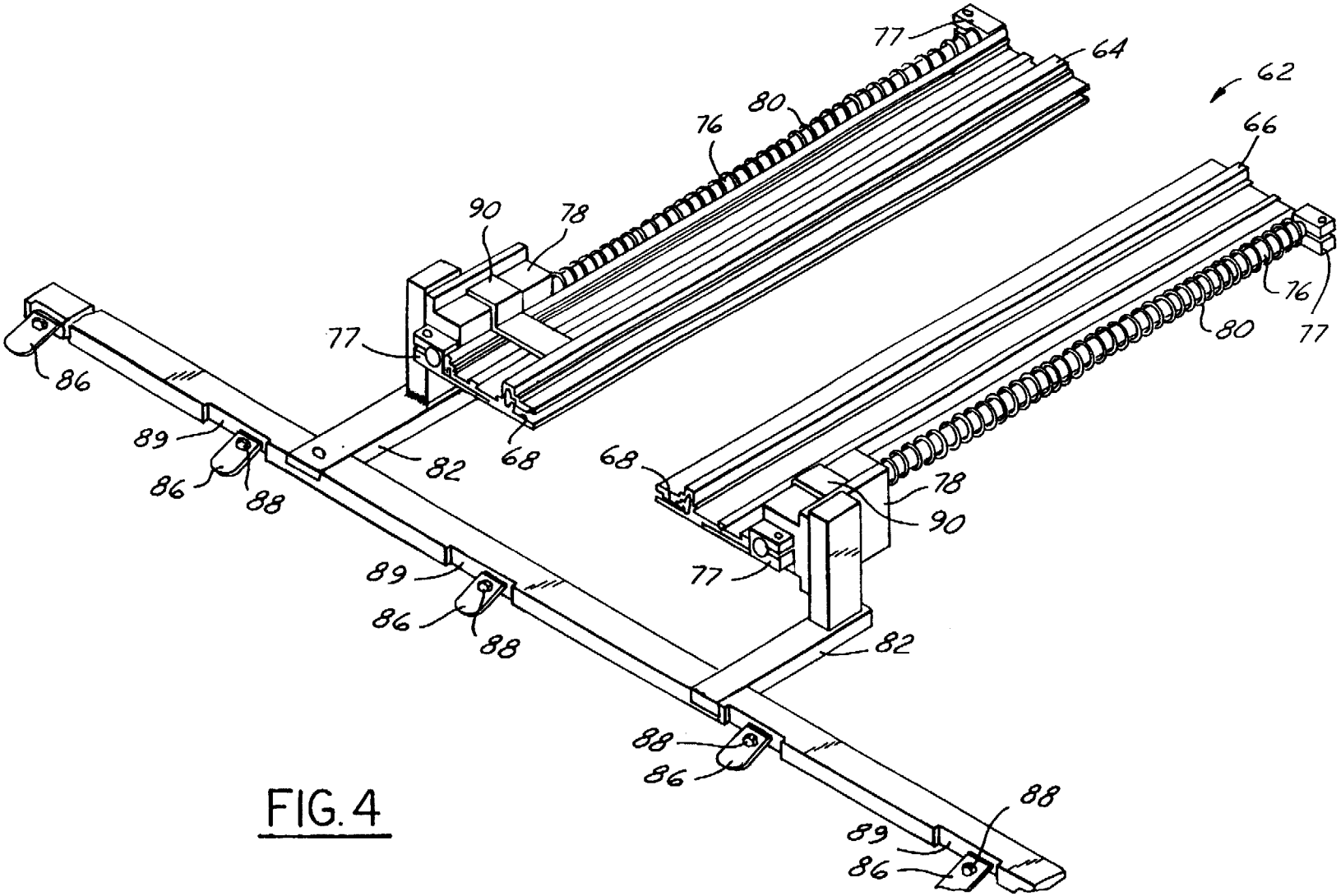
FIG. 4 is a perspective view of a presently preferred embodiment of the indexer illustrated in FIGS. 1–3 apart from the brake.
Figure 6:
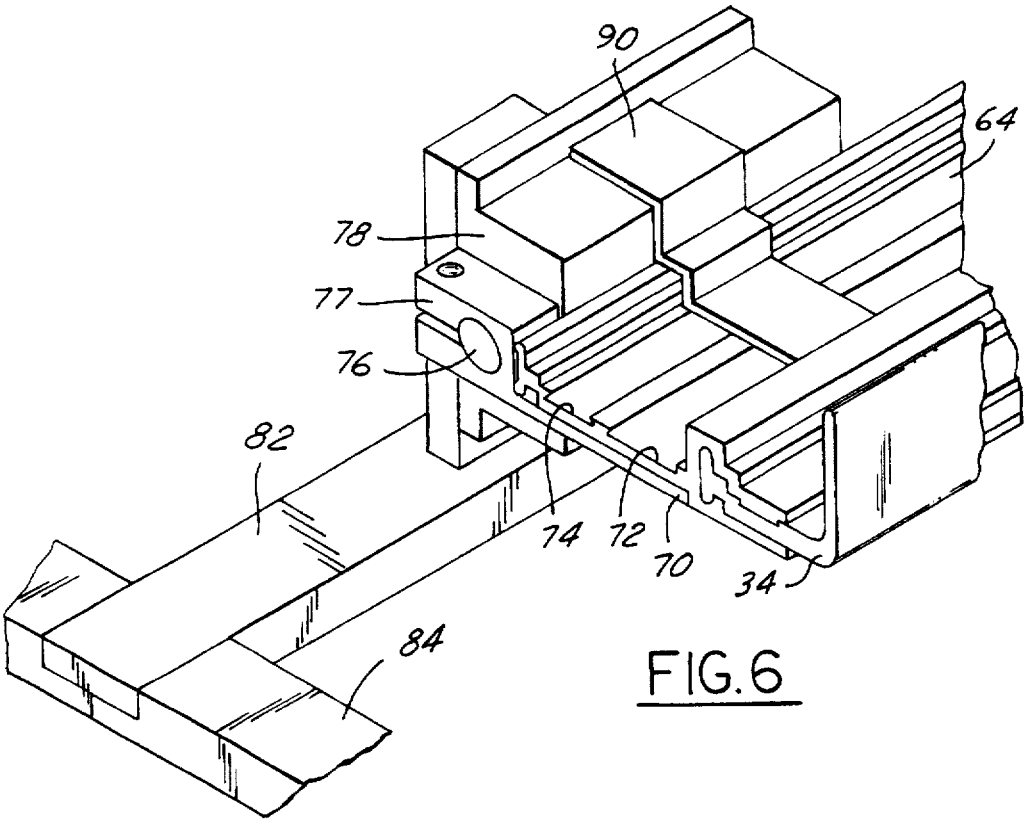
FIG. 6 is a fragmentary perspective view of the indexer illustrated in FIGS. 4–5.

FIGS. 1–3 illustrate a portable sheet bending brake 30 having a plurality of longitudinally spaced C-shaped frame sections 34 interconnected along a lower rear edge by a rear rail 36 and along a lower front edge by a front rail or member 38. The flat upper surface 40 of member 38 forms a clamp surface, against which workpieces in the form of sheet metal or plastic material is clamped for bending or cutting. A second elongated member 42 is mounted on longitudinally spaced arms 44, which are pivotally mounted in pairs on either side of each C-shaped frame member 34. The forward edge 46 of member 42 forms an angulated anvil over which sheet material may be bent. Member 42 is mounted by arms 44 for clamping movement toward and away from clamp surface 40 under control of a handle 48, which is coupled to arms 44 by a plurality of extensible links. As used in this application the term "sheet material" includes precut blank stock and material provided in rolls or coils.

Figure 8:
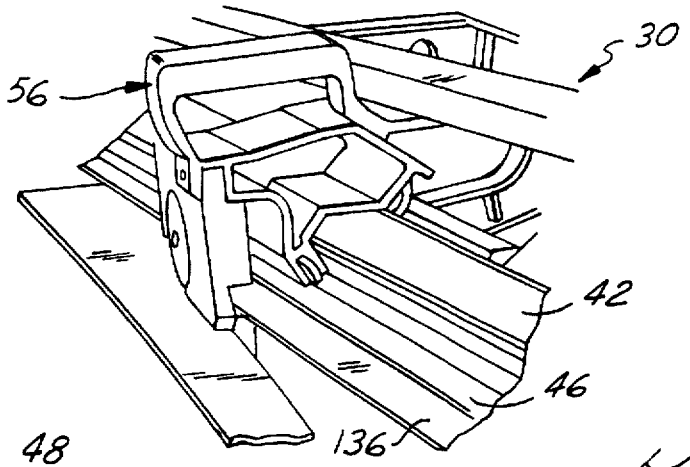
FIG. 8 is a fragmentary front perspective view that illustrates the brake and indexer employed in conjunction with a manual cutter.
Figure 9:
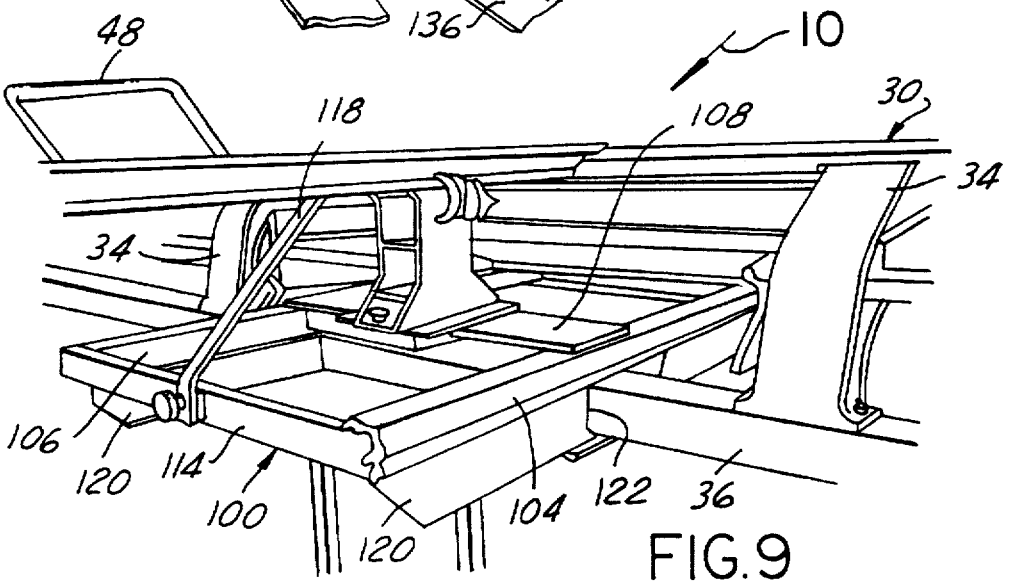
FIG. 9 is a fragmentary rear perspective view of a sheet bending brake and indexer in accordance with a modified embodiment of the invention.
Figure 20:
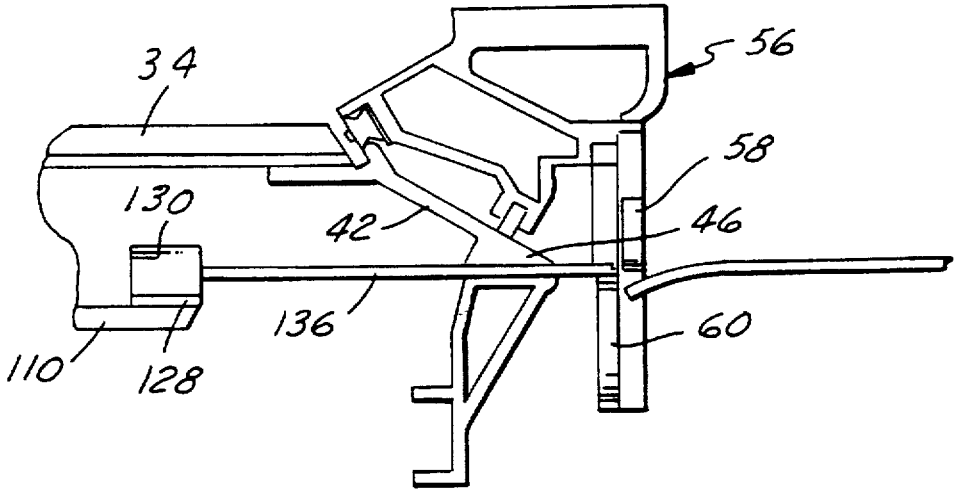
FIG. 20 is a fragmentary end elevational view that illustrates the brake and indexer of FIGS. 9–11 used in conjunction with a manual sheet metal cutter.
Figure 21:
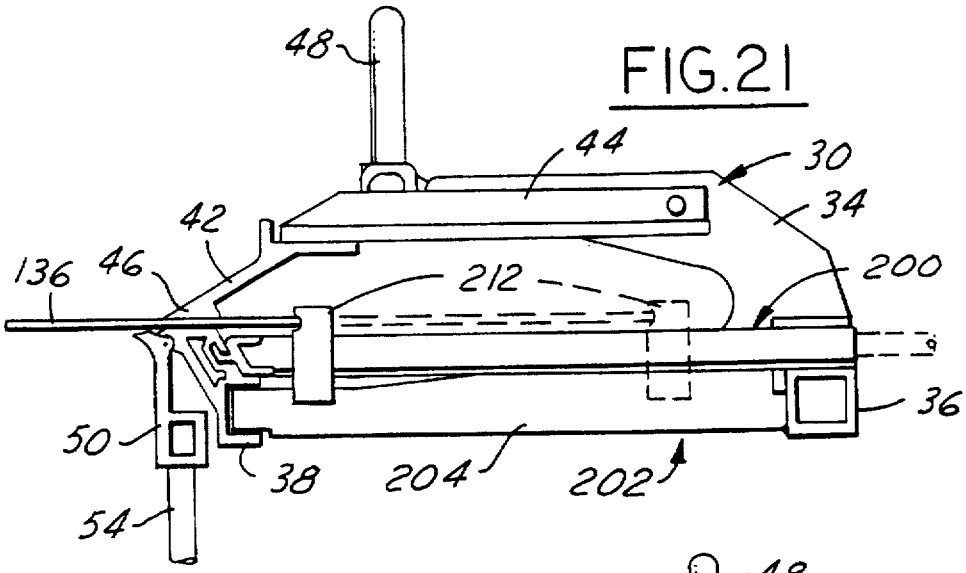
FIG. 21 is an end elevational view of a sheet bending brake and automatic indexer in accordance with a third embodiment of the present invention.

A third rail member 50 is pivotally mounted to fixed member 38 by a hinge 52. One or more handles 54 are coupled to member 50 for pivoting the same upwardly with respect to clamp surface 40, and thereby bending sheet material clamped between members 38, 42 over anvil edge 46 of member 42. Anvil member 42 also includes suitable guides and tracks for receiving and guiding a hand-held sheet metal cutter 56 (FIGS. 8 and 20). To the extent thus far described, sheet bending brake 30 is of conventional construction. A blank of sheet metal to be cut or bent is positioned between members 38, 42, and member 42 is pivoted downwardly by operation of handle 48 so as to clamp the sheet material workpiece in the brake. To perform a bend, member 50 is then pivoted upwardly employing handles 54 so that the sheet material blank is bent over anvil 46 of member 38 to the desired angle. Alternatively, to cut the sheet material blank, cutter 56 is positioned on member 42 as shown in FIGS. 8 and 20, and manually propelled along member 42 lengthwise of the bending brake. The sheet material is cut by operation of a pair of rollers 58, 60 (FIG. 20) carried by cutter 56. To the extent thus far described, bending brake 30 is the same as those disclosed in abovenoted U.S. Pat. Nos. 5,353,620 and 5,505,069, the disclosures of which are incorporated herein by reference.

Cutter 56 and cooperative operation thereof in conjunction with sheet bending brake 30 is disclosed in U.S. application Ser. No. 08/714,215, filed Sep. 16, 1996, now U.S. Pat. No. 5,706,693, and also incorporated herein by reference for purposes of background. It will be noted in FIGS. 8 and 20 that operation of cutter 56 leaves a section of sheet material extending outwardly from bending anvil 46. The width of this material with respect to the anvil edge is predetermined by the design of cutter 56, and remains constant.

In accordance with a presently preferred embodiment of the invention illustrated in FIGS. 1–6, an indexer 62 is affixed to sheet bending brake 30. Indexer 62 functions to square sheet material with respect to anvil 46 as the sheet material is inserted into the brake between members 38, 42, and to measure or index the amount of material inserted into the brake with respect to the anvil edge. Indexer 62 comprises a pair of elongated extruded plates 64, 66, which are identical to each other, having a laterally opening slot 68 (FIG. 5) or other suitable means for fixedly securing the plates to opposed sides of one C-shaped member 34, preferably the member 34 that is centered in brake 30. Screws or other suitable means may be employed to secure plates 64, 66 on opposite sides of member 34. Each plate 64, 66 has a generally planar section 70 that is horizontal in assembly and has a pair of elongated parallel slots 72, 74 formed on the upper surface thereof. A rod-shaped slide 76 is mounted by aligned collars 77 that are integral with sections 70 and disposed on the sides thereof remote from the member 34 to which the plates are mounted. Slide rods 76 are parallel to and coplanar with each other, and are positioned laterally spaced from each other on opposite sides of the associated mounting member 34. A carriage 78 is slidably mounted on each slide rod 76, and is resiliently urged in the forward direction (toward clamp surface 52) by a coil spring 80 captured in compression surrounding each slide rod 76. An arm 82 projects forwardly from each carriage 78, and an elongated synchronizer bar 84 extends longitudinally between the forward ends of arms 82 parallel to anvil edge 46. Thus, carriages 78, arms 82 and bar 84 form a rigid construction that is slidably mounted on rods 76 and urged forwardly (toward clamp surface 40) by compressed coil springs 80. Bar 84 is parallel to and positioned behind and above clamp surface 40 of member 38.

Figure 10:
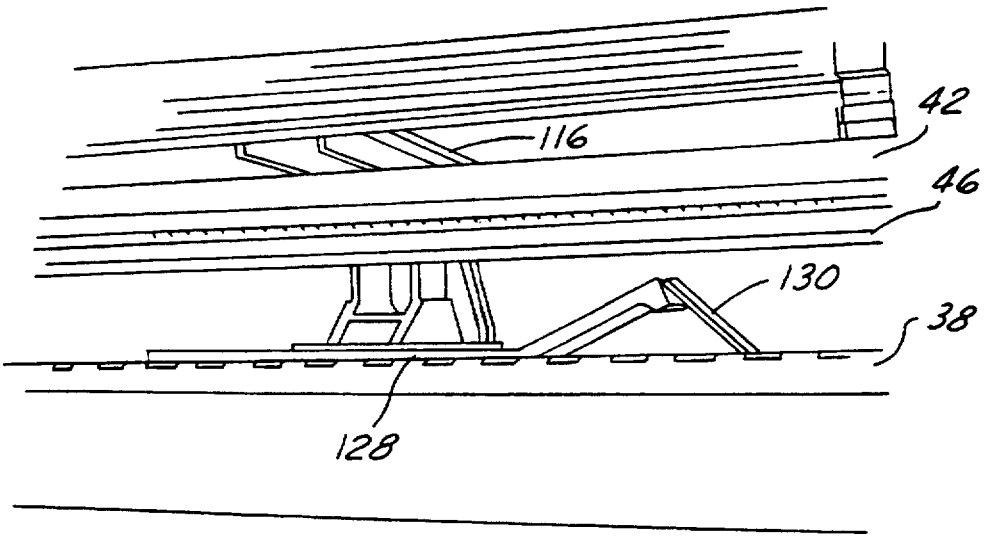
FIG. 10 is a fragmentary front perspective view of the brake and indexer illustrated in FIG. 9, being taken substantially from the direction 10 in FIG. 9.
Figure 22:
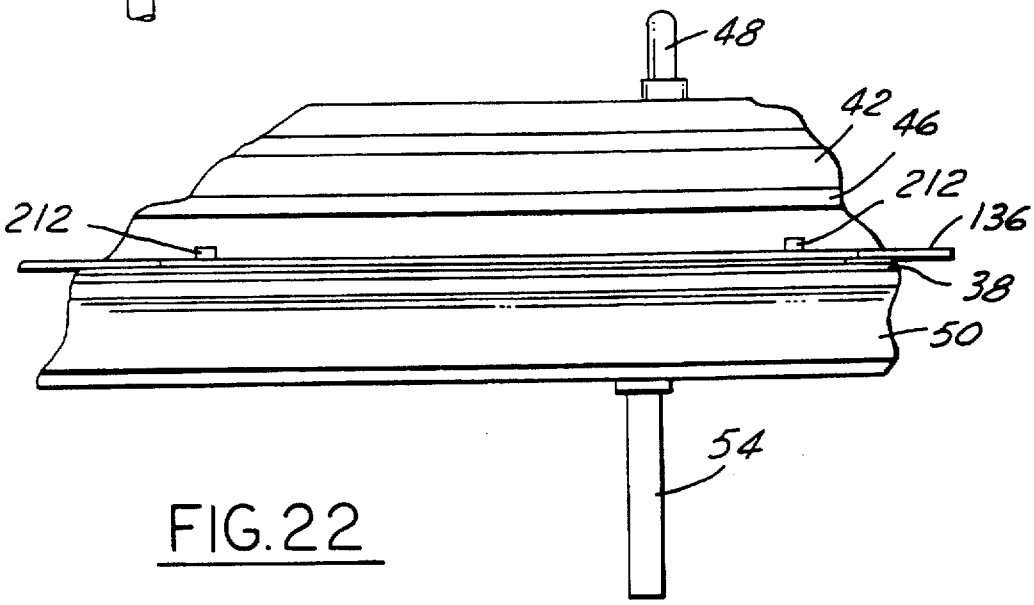
FIGS. 22 and 23 are fragmentary front elevational view of the brake and indexer illustrated in FIG. 21.

A plurality of spaced fingers 86 each have a pivot pin 88 extending therethrough and pivotally mounting the associated finger to the forward edge of bar 84. Each finger 86 is mounted within a pocket formed along the forward edge of bar 84, with each pocket 89 being dimensioned to allow each associated finger 86 to be pivoted upwardly against and aligned with the forward edge of bar 84. The right-hand edge of each pocket is angulated and positioned with respect to the associated pin 88 so as to form an angulated stop against downward pivoting motion of each finger 86 under force of gravity. In assembly with bending brake 30, fingers 86 are positioned and dimensioned so as to be engaged by an edge of a section of sheet material inserted between members 38, 42 (with member 42 in the upper or unclamped position illustrated in FIGS. 10 and 22). Slots 74 are dimensioned to receive scales 92 having indicia along the upper surface thereof coordinated with distance between fingers 86 on bar 84, and anvil edge 46 of member 42, as will be described. Slots 72, preferably of wider dimension than slots 74, are adapted to receive template strips 98' for bending sheet material to suit a specific application, as will be described. A bracket 90 extends laterally from each carriage 78 over slots 72, 74 of the associated plate 64, 66. An edge of each bracket 90 may be employed in conjunction with scale 92 and/or template strip 98' for indexing sheet material workpieces for cutting or bending, as will be described. At least one carriage 78 has a lateral opening that receives a threaded shaft coupled to a handle 96. This handle may be rotated to bring the threaded shaft into engagement with rod 76 for locking the carriage in position.

In operation, assume first that it is desired to cut a blank of sheet material to a predetermined width. This length of sheet material may be either of precut length, or may be unrolled and cut from a coil platform or stand mounted at one end of sheet bending brake 30, as disclosed in U.S. application Ser. No. 08/611,936 filed Mar. 6, 1996, now U.S. Pat. No. 5,706,692. The coil stand in this referenced application is adapted to be mounted on the right-hand end of the sheet bending brake, and fingers 86 are angulated with respect to bar 84 such that they automatically pivot upwardly out of the way as a length of sheet material is drawn from a coil stand so disposed. When the desired length of sheet material has been withdrawn from the coil, severed from the coil to form a blank and drawn outwardly from the sheet bending brake, fingers 86 automatically pivot downwardly by force of gravity to the operating positions illustrated in the drawings. The blank of sheet material is then moved back into the bending brake between fixed member 38 and movable member 42 until the inner edge thereof engages and abuts fingers 86. Continued inward motion of the sheet material blank pushes fingers 86, bar 84, arms 82 and carriages 78 along slide rods 76 against the forces of springs 80. During this inward motion, fingers 86, bar 84, arms 82 and carriages 78 automatically square the edge of sheet material engaged by fingers 86 with respect to anvil 46. During this operation, the operator observes the position of carriages 78 with respect to the scales 92 and/or template strip 98' mounted on plates 64, 66. Preferably, one of such scales has indicia that is offset from anvil 46 by an amount equal to the portion of sheet material left extending from the sheet bending brake upon operation of the cutter, as illustrated in FIGS. 8 and 20. Thus, for example, the operator may observe that one edge of bracket 90 is aligned with a "six inch" mark on the scale to be used for a cutting operation. The operator would then clamp member 42 downwardly against member 38 by operation of handle 48 so as to clamp the sheet material blank firmly between members 38, 42, and then run cutter 56 along the guide tracks of member 42 (see FIGS. 8 and 20). The material left within the bending brake would then be six inches in width, as desired by the operator.

To perform a bending operation a like process may be employed, but employing the second scale 92 that is coordinated with a direct measure of the distance between fingers 86 and anvil edge 46 without offset. For example if it is desired to make a 90° bend four inches into the blank of sheet material previously cut six inches wide, the sheet material blank is inserted between brake members 38, 42 until an edge of bracket 90 aligns with the "four inch" measure on the appropriate scale 92. The sheet material is then clamped in position by operation of handle 48, and handles 34 are operated in the usual manner to make the desired bend. If either the described cutting operation or the described bending operation is to be repeated on multiple pieces, carriages 78 may be manually moved along rods 76 to the desired index position and then locked in position by operation of knob 96. When so locked in position, bar 84 and fingers 86 operate as a fixed abutment stop against insertion of sheet material into the bending brake, thus providing a cut or bend at the desired position without repeated operator observation of the indexer indicia. It is also contemplated that bracket 90 may be fabricated in a width that corresponds to the offset needed for precise operation of cutter 56, so that the scales 92 on both sides may be identical and the operator use one edge of bracket 90 for bend indexing and the other edge of bracket 90 for cut indexing.

Figure 7A:
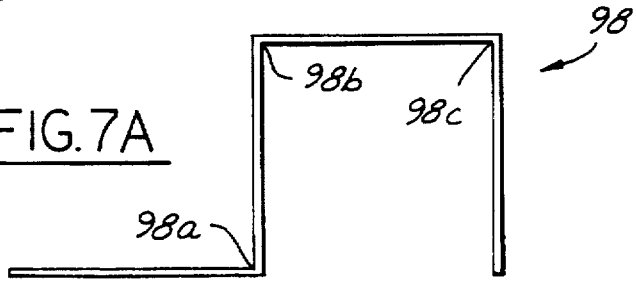
FIGS. 7A–7C illustrate a bending template strip that may be employed in conjunction with the bending brake and indexer illustrated in FIGS. 1–6.
Figure 7B:
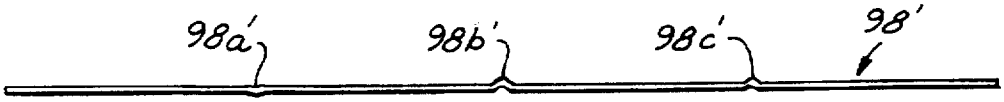
Figure 7C:
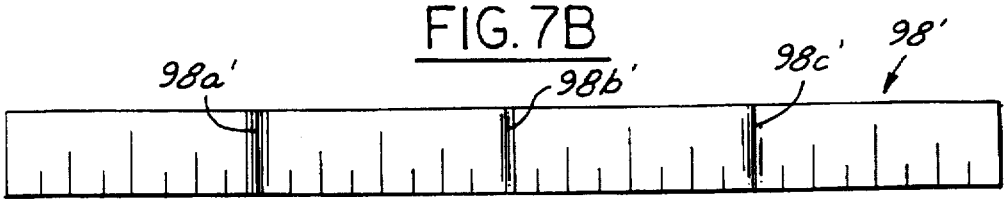

Precision compound bending may also be accomplished by means of template strip 98' formed according to the technique illustrated in FIGS. 7A–7C. A strip 98 of malleable material is selected and bent to the desired contour, as shown in FIG. 7A. Strip 98 may be of scrap sheet aluminum, for example, or may be precut and provided in packages. Prefabricated strips 98 may bear distance indicia (FIG. 7C) to assist in making the desired bends. In any event, after template strip 98 is formed to the desired contour illustrated in FIG. 7A, it is then reflattened as illustrated at 98' in FIGS. 7B and 7C. The bends **98*a*, 98*b*, 98*c* in FIG. 7A leave clearly discernable bend stress lines 98*a'*, 98*b'*, 98*c'* in FIG. 7B and FIG. 7C. According to conventional practice, the flattened template strip 98' of FIGS. 7B and 7C is then placed along the longitudinally spaced ends of the sheet aluminum stock to be bent, and the sheet stock is then either marked as with a pencil or cut by snips at positions corresponding to the desired bends. This time-consuming project is described above. In accordance with an important feature of the present invention, flattened template strip 98' (FIGS. 7B and 7C) is inserted into slot 72, being retained therein by the dovetail contour of the slot. Bracket 90 (or other suitable pointer carried by carriages 78) is then employed in conjunction with template strip 98' to index sequential bends in the sheet material workpiece. Template 98'** may be employed repeatedly for making identical bends on a series of workpieces, such as for forming identical window molding sections for a house.

Indexer 62 illustrated in FIGS. 1–6 is adapted to be assembled as part of sheet bending brake 30 at the time of original manufacture, and thus becomes a permanent part of the sheet bending brake. FIGS. 9–20 illustrate an indexer 100 that is adapted to be provided as a separate construction for mounting to a sheet bending brake 30 as an add-on in the aftermarket. Indexer 100 comprises a rectangular frame 102 that includes spaced slide tubes 104, 106 affixed to each other by a forward frame section 108. A pair of elongated carriages 110, 112 are respectively slidably received within slide tubes 104, 106, and are interconnected to each other by a rear frame section 114. A platen 116 is carried by frame section 108 and extends parallel to slide tubes 104, 106 in an elevated plane with respect thereto. An arm 118 is affixed to and projects upwardly forwardly from frame section 114 affixed to carriages 110, 112, and is slidably disposed over platen 116. A bracket 120 depends from each slide tube 104, 106. Brackets 120 have notches 122 that are laterally aligned with each other and dimensioned for receipt over rear rail 36 of sheet bending brake 30. An arm 124 (FIGS. 11 and 13) is pivotally carried at the underside of each bracket 120. Each arm 124 carries a screw affixed to a handle 126 for alignment with a threaded opening in rail 36 for embracing brake rail 36 and affixing indexer 100 in position.

A bar 128 extends between and is affixed to the forward ends of carriages 110, 112, thereby cooperating with the carriages and with rear bar 114 to form a rigid assembly slidably mounted within slide tubes 104, 106. A pair of L-shaped fingers 130 are pivotally mounted on the opposed longitudinally spaced ends of bar 128. Each finger 130 is mounted to the associated end of bar 128 by a pivot pin 132 (FIGS. 19A and 19B), and is normally pivoted upwardly with respect to bar 128 by means of a coiled spring 134 captured in compression between the lower end of each finger 130 and the opposing under surface of bar 128 beneath pivot pin 132. Fingers 130 are thus normally urged upwardly to a position for engagement with a sheet material blank 136 inserted between members 38, 42 of bending brake 30. On the other hand, in the event that sheet material is drawn from a coil disposed on a stand at either end of the sheet bending brake, the L-shaped construction of fingers 30 will automatically pivot the fingers downwardly to allow passage of the sheet material.

Figure 11:
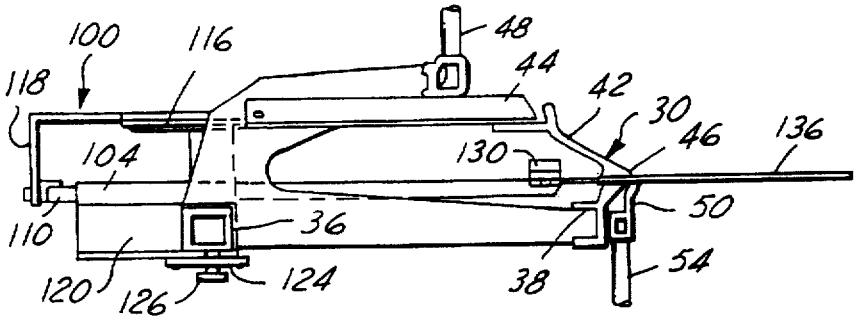
FIG. 11 is an end elevational view of the brake and indexer illustrated in FIGS. 9–10.
Figure 12:
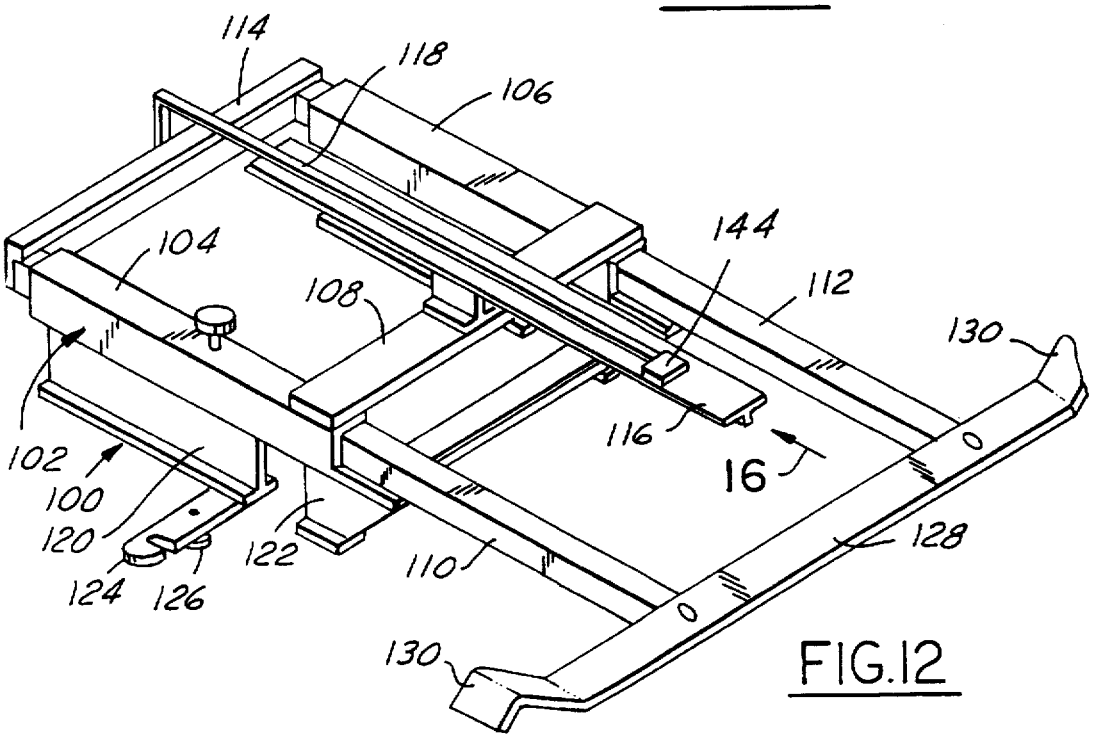
FIG. 12 is a perspective view of the indexer illustrated in FIGS. 9–11 apart from the brake.
Figure 13:
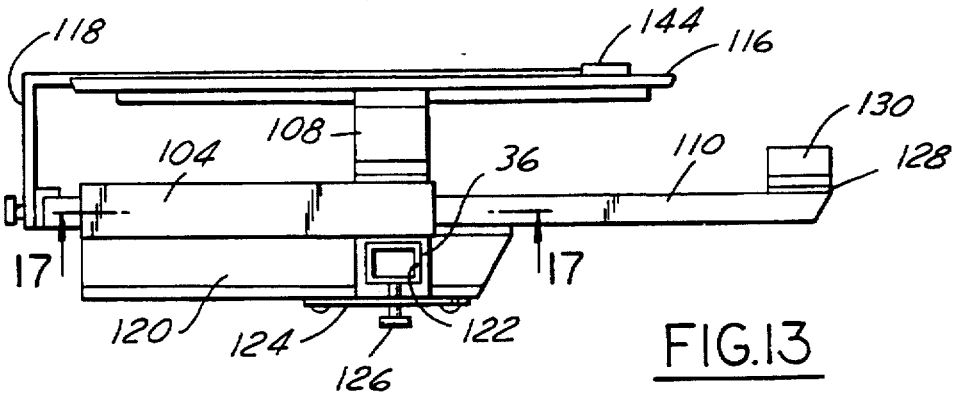
FIG. 13 is a side elevational view of the indexer illustrated in FIG. 12.
Figure 14:
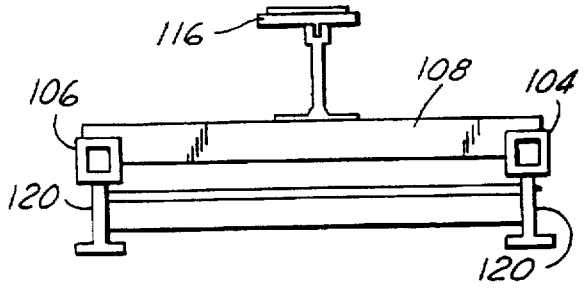
FIG. 14 is an end elevational view of the indexer illustrated in FIGS. 12–13.
Figure 15:
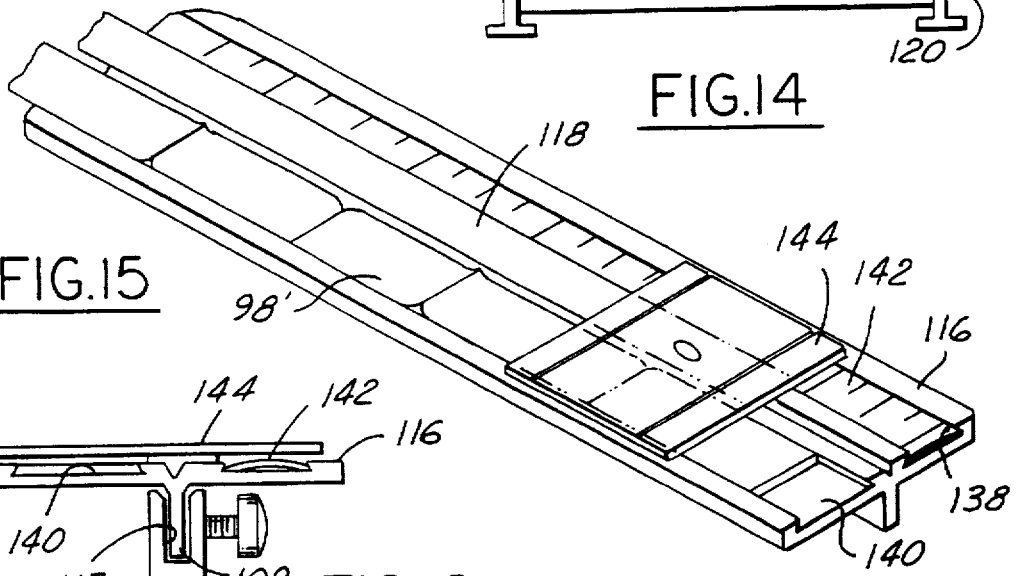
FIG. 15 is a fragmentary front perspective view of a portion of the indexer illustrated in FIGS. 12–14.
Figure 16:
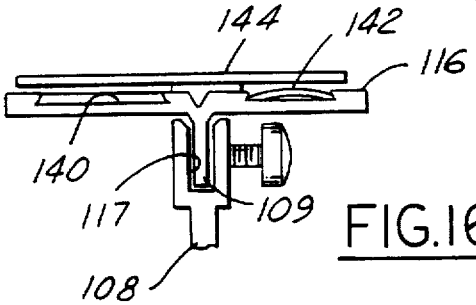
FIG. 16 is a fragmentary end elevational view of the portion of the indexer illustrated in FIG. 12, being taken substantially from the direction 16 in FIG. 12.
Figure 17:
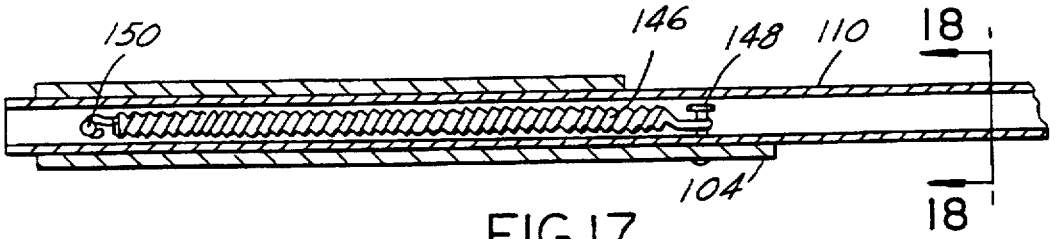
FIG. 17 is a fragmentary sectional view taken substantially along the line 17—17 in FIG. 13.
Figure 18:
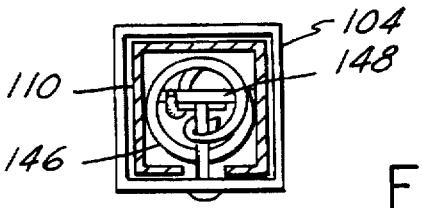
FIG. 18 is a sectional view taken substantially taken along the line 18—18 in FIG. 17.
Figure 19A:
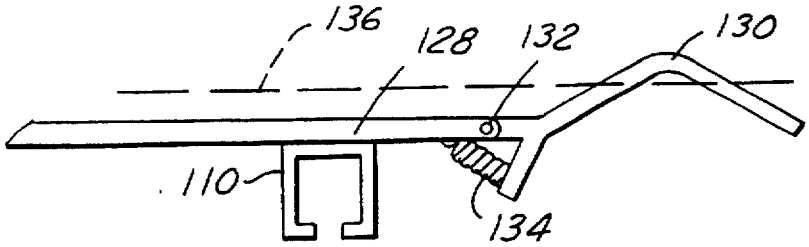
FIGS. 19A and 19B are fragmentary schematic diagrams that illustrate operation of the fingers for engaging the edge of sheet material in the indexer of FIGS. 11–18.
Figure 19B:
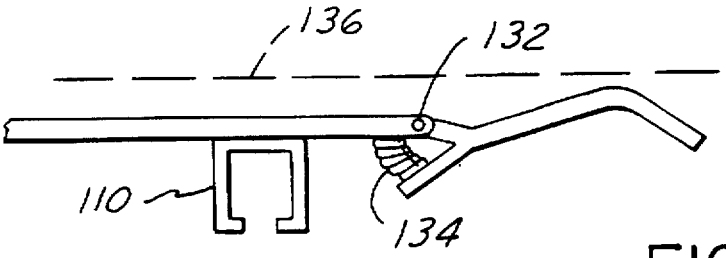

A pair of elongated parallel dovetail slots 138, 140 extend longitudinally along the upper surface of platen 116. Slot 138 is dimensioned to receive a scale 142 bearing linear measurement indicia related to distance to the anvil edge of member 42 in the clamped position of the latter. Slot 140 is dimensioned to receive a flattened template strip 98' as previously described. A plate 144 is carried at the forward end of arm 118 with lines, pointers or other suitable indicia for registry with the indicia on scale 142 or the bend stress marks on template strip 98'. Preferably, plate 144 bears both standard and offset indexing marks so that a single scale 142 can be used for both bending and cutting. Platen 116 has a depending flange 117 (FIG. 16) that is received in a slot 109 that opens upwardly from frame section 108. A screw 145 extends into slot 109 and is coupled to a knob 147 for tightening against flange 117 and thereby locking platen 116 in position. This permits adjustment of indexer 100 to the sheet bending brake. A coil spring 146 is captured in tension within each carriage 110, 112 between a pin 148 affixed to slide tubes 104, 106, and a pin 150 that extends across the interior of each carriage 110, 112. Thus, insertion of sheet material blank 136 between the elements of bending brake 30 engages fingers 130 as shown in FIGS. 11, 19A and 20, and urges the fingers, bar 128 and carriages 110, 112 inwardly against the force of springs 146. When the desired position on scale 142 or template strip 98' has been reached according to observation through indexer plate 144, the brake is clamped and the desired bend or cut is performed. A screw 160 extends into slide tube 104 for engagement with carriage rail 110, and bears a knob 162 for tightening screw 160 and thereby locking the carriage in position.

Figure 23:
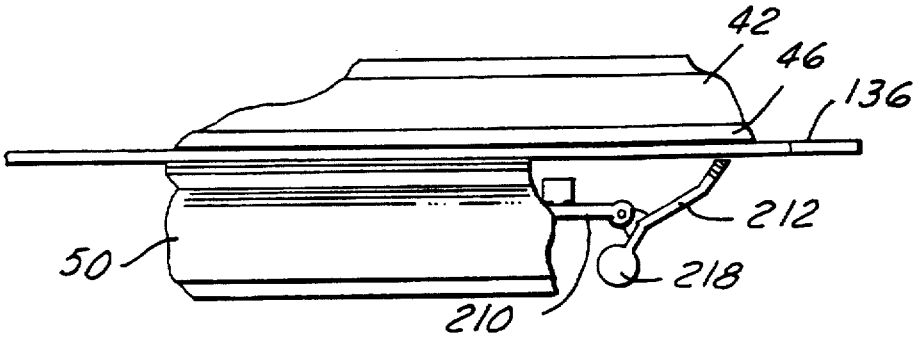
Figure 24:
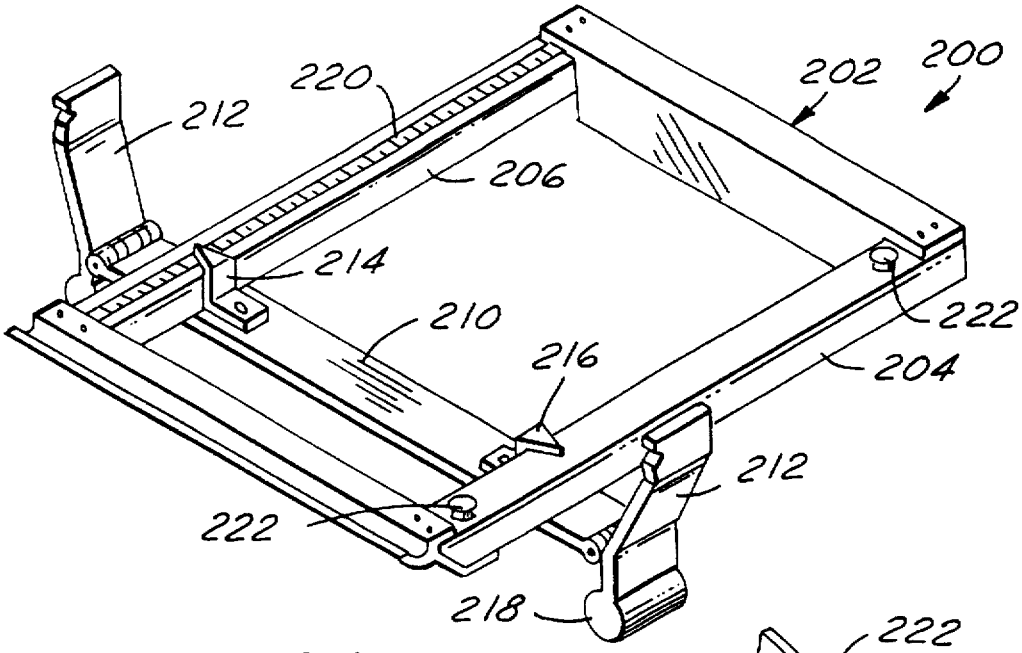
FIG. 24 is a perspective view of the indexer illustrated in FIGS. 21–23 apart from the brake.
Figure 25:
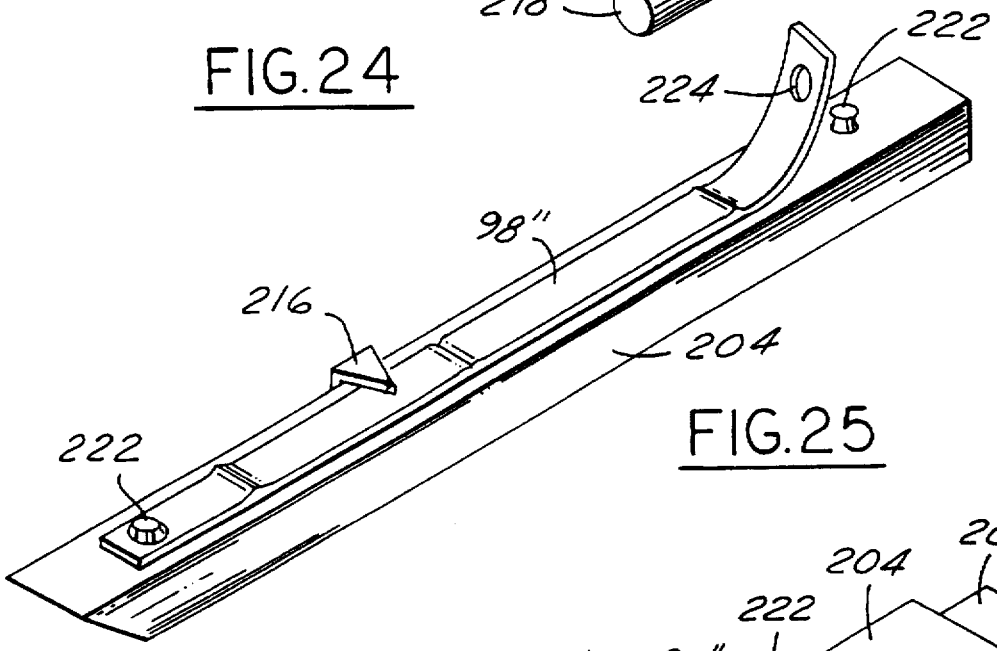
FIGS. 25 and 26 are fragmentary perspective views of portions of the indexer illustrated in FIG. 24.
Figure 26:
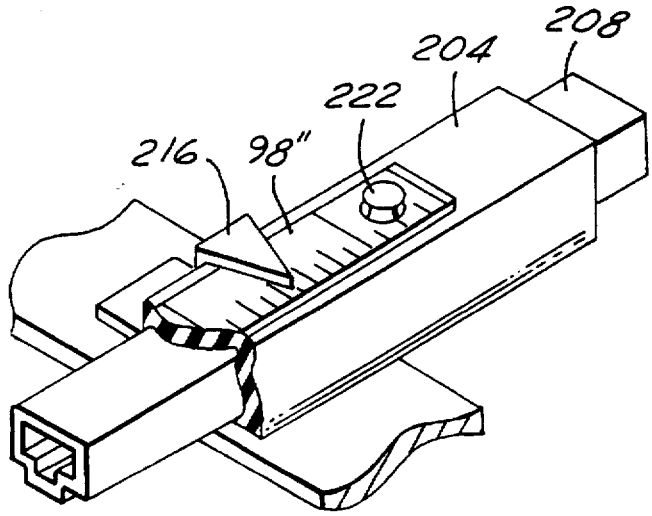
Figure 27:
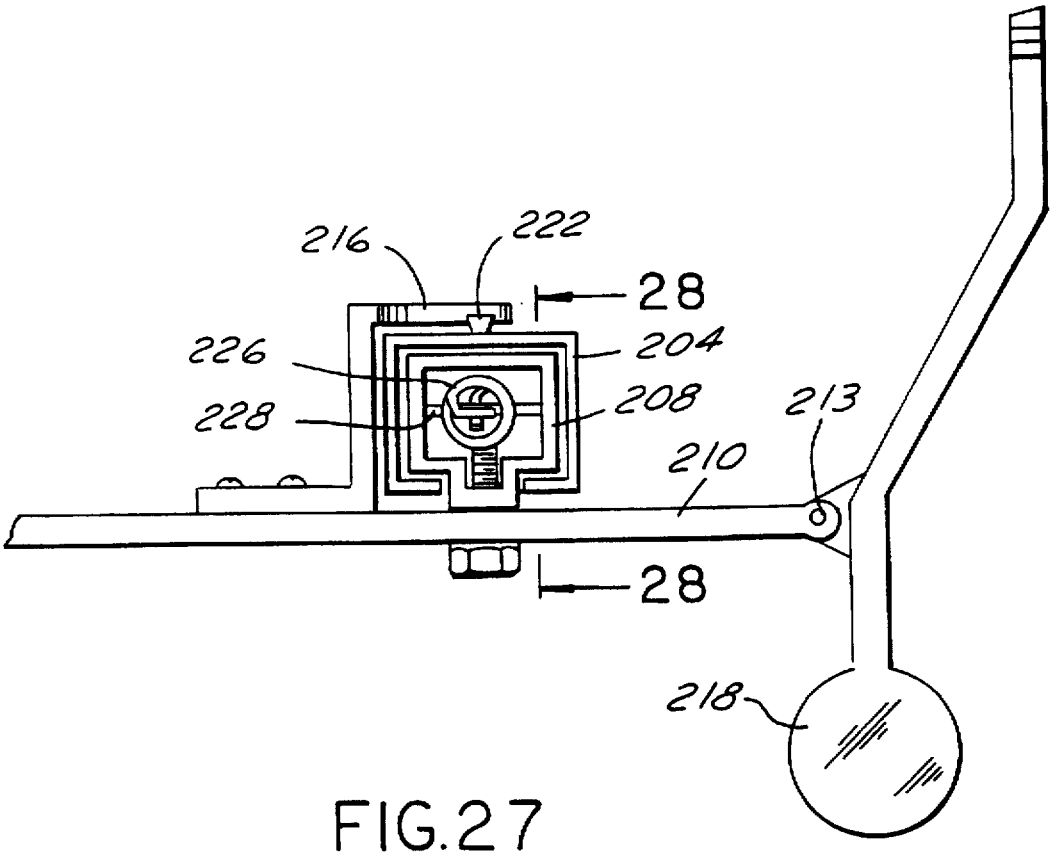
FIG. 27 is a fragmentary elevational view of a portion of the indexer illustrated in FIG. 24.
Figure 28:
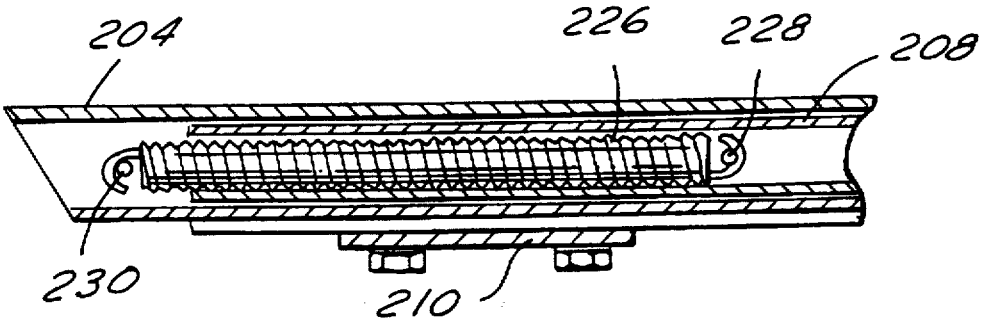
FIG. 28 is a fragmentary sectional view taken substantially along the line 28—28 in FIG. 27.

FIGS. 21–28 illustrate another indexer 200 in combination with an otherwise conventional sheet bending brake 30. Indexer 200 is removably mounted on sheet bending brake 30 by a mechanism similar to that shown in FIG. 11, and comprises a rigid frame 202 that includes spaced parallel slide tubes 204, 206. A carriage tube 208 is slidably received within each slide tube 204, 206. A bar 210 is affixed to and extends between the carriage tubes 208 within each slide tube 204, 206, extending laterally outwardly therefrom so as to receive fingers 212. Fingers 212 are pivotally mounted by pins 213 on the opposed ends of bar 210. Bar 210 also carries a pair of laterally outwardly oriented pointers 214, 216 having the ends thereof disposed above slide tubes 204, 206. Carriage tubes 208 thus mount bar 210, fingers 212 and pointers 214, 216 for sliding motion with respect to slide tubes 204, 206 of frame 202. Fingers 212 have integral enlarged lower portions 218 forming masses for gravitationally biasing the fingers to the upward orientations illustrated in FIGS. 21, 22, 24 and 27. The fingers may be biased downwardly to permit sheet material blank 136 to be drawn between the bending brake elements, as illustrated in FIG. 23.

A scale 220 bearing linear measurement indicia is disposed along the top of slide tube 206 adjacent to and beneath the end of pointer 214. A pair of spaced pins 222 are disposed at respective ends along the upper surface of slide tube 204. A bending template strip 98" may thus be mounted on the upper surface of slide tube 204 by means of apertures 224 formed at the opposing ends of the strip. The strip will thus cooperate with pointer 216 for indexing the sheet material to the desired bend positions while maintaining the sheet material square to the bending anvil, as previously described. A coil spring 226 is captured in tension within each carriage tube 208 between a pin 228 that extends across carriage tube 208 and a pin 230 that extends across each slide tube 204, 206. Template strips 98 (FIG. 7A) may be made from scrap at a job cite, or may be provided in packages. The template strips may be either of sheet metal, plastic or composite construction. A plastic or composite strip material that provides bend stresses of different colors depending on the bend direction would be particularly useful. A template strip material on which the operator may identify the elements for which the strip was made would be useful for element replacement after a storm, for example. Preferably, preconstructed template strips have a scale along one or both surfaces to assist the operator in forming the desired contour.

The retrofit versions of the indexer (FIGS. 12 and 24) may be provided in forms suitable for use in conjunction with sheet bending brakes of different manufacturers.

We claim:

1. An automatic indexer for a sheet bending brake having a first longitudinally extending member forming a clamp surface, a second longitudinally extending member movable toward and away from said first member for clamping sheet material against said surface and having a longitudinal edge forming a bending anvil, and a third member pivotally coupled to said first member for bending over said bend anvil sheet material clamped between said first and second members, said indexer comprising:

a pair of slide means including means for mounting said slide means on the brake parallel to each other and spaced from each other lengthwise of said clamp surface, a pair of carriage means each slidably disposed on one of said slide means, means extending between said carriage means for engagement with an edge of sheet material inserted between said first and second members on the brake, means for resiliently biasing said carriage means toward said clamp surface, and means coupled to said carriage means for relating distance from said anvil to an edge of sheet material in engagement with said engagement means, said distance-relating means comprising means disposed in fixed position relative to said slide means, and means on said fixed means for coordination with position of at least one of said carriage means on at least one of said slide means to relate distance from said anvil to an edge of sheet material in engagement with said engagement means.

2. The indexer set forth in claim 1 wherein said coordination means comprises means variable positionable with respect to said fixed means.

3. The indexer set forth in claim 1 wherein said coordination means comprises an elongated slot on said fixed means extending parallel to said slide means and contoured to receive a template strip having longitudinally spaced bend indicia positioned thereon.

4. The indexer set forth in claim 3 wherein said bend indicia comprise a scale on said template strip.

5. The indexer set forth in claim 3 wherein said bend indicia comprise bend stresses in said template strip.

6. The indexer set forth in claim 1 wherein said coordination means comprises retaining means on said fixed means to receive and hold a template strip on said fixed means.

7. The indexer set forth in claim 1 wherein said coordination means comprises a scale on said fixed means.

8. The indexer set forth in claim 7 wherein said scale comprises means for providing a direct measurement between said anvil and an edge of sheet material engagement with said engagement means.

9. The indexer set forth in claim 7 wherein said scale comprises means for providing an offset measurement between said anvil and an edge of sheet material in engagement with said engagement means.

10. The indexer set forth in claim 9 for a portable sheet bending brake in which said second member includes means for receiving and guiding a cutter along said second member to sever sheet material clamped between said first and second members along a line offset by a predetermined distance from said anvil, wherein said scale provides said offset measurement equal to said predetermined distance.

11. The indexer set forth in claim 1 wherein said engagement means comprises a plurality of spaced fingers and means mounting said fingers for engagement with an edge of sheet material inserted between said first and second members.

12. The indexer set forth in claim 11 wherein said finger-mounting means comprises means for disposition on the sheet bending brake below the clamp surface, said fingers extending upwardly from said finger-mounting means.

13. The indexer set forth in claim 11 wherein said finger-mounting means comprises means for disposition on the sheet bending brake above the clamp surface, said fingers extending downwardly from said finger-mounting means.

14. The indexer set forth in claim 11 wherein said fingers are pivotally mounted on said finger-mounting means.

15. The indexer set forth in claim 14 wherein said fingers include means for biasing said fingers to a pivotal position with respect to said finger-mounting means for engagement with an edge of sheet material inserted between said first and second members.

16. The indexer set forth in claim 15 wherein said finger-mounting means includes pockets into which said fingers are pivoted.

17. The indexer set forth in claim 15 wherein said biasing means comprises spring means captured between said fingers and said finger-mounting means.

18. The indexer set forth in claim 15 wherein said biasing means comprises means on said fingers for gravitationally biasing said fingers.

19. The indexer set forth in claim 1 wherein said means for mounting said slide means includes means for fixedly mounting said indexer to the sheet bending brake.

20. The indexer set forth in claim 1 wherein said means for mounting said slide means includes means for removably mounting said indexer to the sheet bending brake.

21. The indexer set forth in claim 1 wherein said slide means comprises spaced rods, and wherein said resiliently biasing means comprises coil springs encircling said rods in engagement with said carriage means.

22. The indexer set forth in claim 1 wherein said slide means comprises spaced tube sections, wherein said carriage means comprises elongated means disposed for sliding within said tube sections, and wherein said biasing means comprises coil springs disposed within said tube sections and resiliently coupling the tube sections to said elongated means.

23. The indexer set forth in claim 1 further comprising means for locking said carriage means with respect to said slide means such that said engagement means forms a fixed abutment against insertion of sheet material between said first and second members.

24. A combined sheet bending brake and automatic indexer that comprises:

a sheet bending brake having a first longitudinally extending member forming a clamp surface, a second longitudinally extending member movable toward and away from said first member for clamping sheet material against said surface and having a longitudinal edge forming a bending anvil, and a third member pivotally coupled to said first member for bending over said anvil sheet material clamped between said first and second members, and an indexer that comprises:

a pair of slide means including means mounting said slide means on said brake parallel to each other and spaced from each other lengthwise of said clamp surface, a pair of carriage means each slidably disposed on one of said slide means, means extending between said carriage means for engagement with an edge of sheet material inserted between said first and second members, means for resiliently biasing said carriage means toward said clamp surface, and means coupled to said carriage means for relating distance from said anvil to an edge of sheet material in engagement with said engagement means, said distance-relating means comprising means disposed in fixed position relative to said slide means, and means on said fixed means for coordination with position of at least one of said carriage means on at least one of said slide means to relate distance from said anvil to an edge of sheet material in engagement with said engagement means.

* * * * *